United States Patent [19]

Tobin

[11] Patent Number: 4,613,134

[45] Date of Patent: Sep. 23, 1986

[54] METHOD OF PLAYING A BOARD GAME UTILIZING A BOARD WITH DIFFERENT ZONES

[76] Inventor: Gerard J. Tobin, 12 Birchwood Rd., Enfield, Conn. 06095

[21] Appl. No.: 783,835

[22] Filed: Oct. 3, 1985

Related U.S. Application Data

[62] Division of Ser. No. 595,317, Mar. 30, 1984, abandoned.

[51] Int. Cl.[4] ..... A63F 3/02

[52] U.S. Cl. ..... 273/242; 273/288; 273/258

[58] Field of Search ..... 273/242, 260, 261, 262, 273/258

[56] References Cited

U.S. PATENT DOCUMENTS

| | | | |
|---|---|---|---|
| 1,772,583 | 8/1930 | Barrett | 273/260 |
| 3,844,563 | 10/1974 | Isaac | 273/260 |
| 4,036,501 | 7/1977 | Hovnanian | 273/260 X |

FOREIGN PATENT DOCUMENTS

| | | | |
|---|---|---|---|
| 15213 | of 1901 | United Kingdom | 273/260 |
| 514846 | 11/1939 | United Kingdom | 273/262 |

*Primary Examiner*—Richard C. Pinkham
*Assistant Examiner*—Matthew L. Schneider
*Attorney, Agent, or Firm*—L. James Ristas

[57] ABSTRACT

A game for two players including a flat board (10) on which is delineated a uniform rectilinear grid (14, 16) defining eight adjacent rows and columns of square spaces (18). Each space is associated with one of four types of zones. A home zone (24*a,b*) spans each of the northern and southern ends of the grid, immediately in front of the players. A side zone (44) is located at each of the eastern and western ends of the grid, extending between the opposed home zones. A safe zone (46) of contiguous spaces is centered on the grid, and the remaining spaces constitute the playing zone (48). Each player controls a plurality of game pieces (26) having distinct values (28,30,32,34) indicating the number of spaces the piece can move during a turn. The pieces are initially placed in the home zone (24), and can move diagonally as well as rebound off other pieces or zone boundaries. Scoring is dependent on the number and value of pieces reaching the opponent's home zone, the number and value of pieces captured, the positions of the pieces at the end of the game, and whether captured pieces had previously entered the safe zone to avoid capture.

10 Claims, 19 Drawing Figures

METHOD OF PLAYING A BOARD GAME UTILIZING A BOARD WITH DIFFERENT ZONES

This is a divisional of co-pending application Ser. No. 595,317 filed on Mar. 30, 1984, now abandoned.

BACKGROUND OF THE INVENTION

This invention relates to games and more particularly to a game with a board in which two opposing players move game pieces across spaces on the board.

One purpose of the invention is to provide a game having limited rules, reasonable strategy for injecting skill, and a definite ending point after reasonable playing time.

SUMMARY OF THE INVENTION

According to the invention, a flat board has delineated thereon a uniform rectilinear grid defining a plurality of adjacent rows and columns of square spaces. Each space is associated with one of four types of zones. A home zone spans each of the northern and southern ends of the grid, immediately in front of the respective players. A side zone is located at each of the eastern and western ends of the grid, extending between the opposite home zones. A safe zone of contiguous spaces is centered on the grid, and the remaining spaces constitute the playing zone.

Each player controls a plurality of game pieces having different values corresponding to values associated with the spaces in the home zone and the number of spaces the piece moves in a turn. The object of the game for each player is to move his playing pieces from his home zone to his opponent's home zone. One player's home zone is the other player's scoring area.

The present game features diagonal movements including rebounding off other pieces or zone boundaries, capture of the other player's pieces, and a safety zone which protects a piece from capture. Furthermore, scoring is dependent on the number and value of pieces reaching the scoring area, the number and value of captured pieces, the position of the pieces at the end of the game, and whether a captured piece had previously sought refuge in the safe zone.

BRIEF DESCRIPTION OF THE DRAWINGS

Additional objectives and features of this invention will become evident in connection with the description of the best mode and preferred embodiment of the game as set forth below with reference to the accompanying drawings, in which.

DESCRIPTION OF THE PREFERRED EMBODIMENT

THE BOARD AND PIECES

Figure 1:
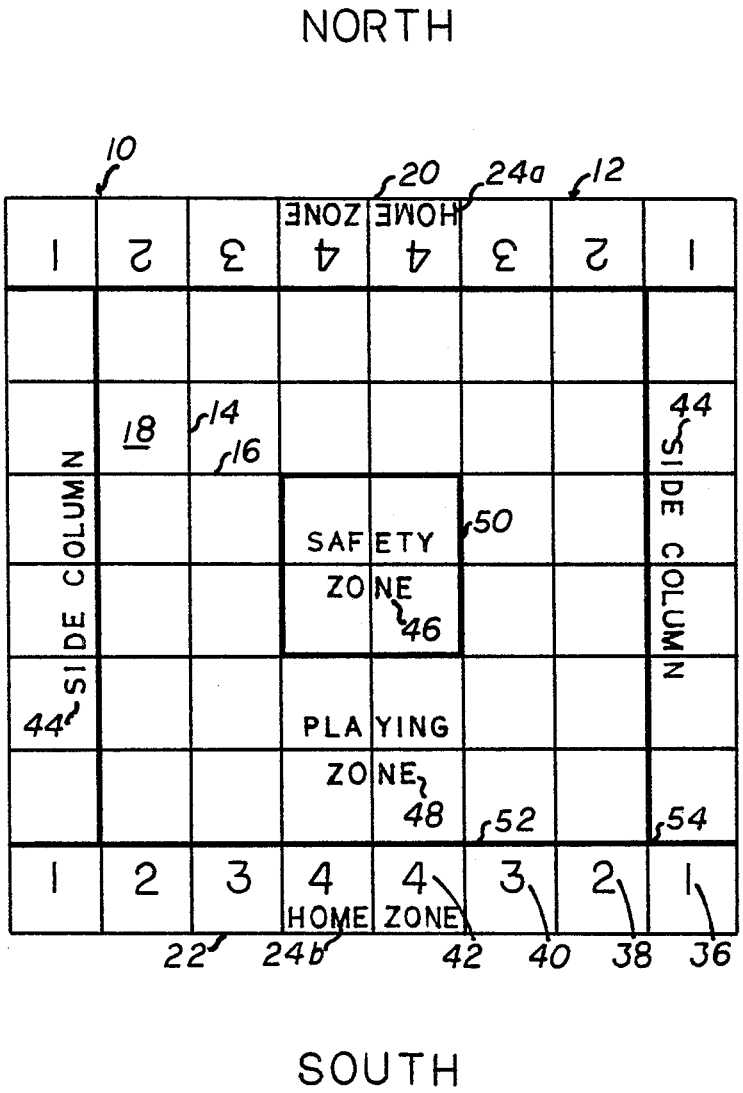
FIG. 1 is a plan view of the game board in accordance with the preferred embodiment of the invention.
Figure 2:
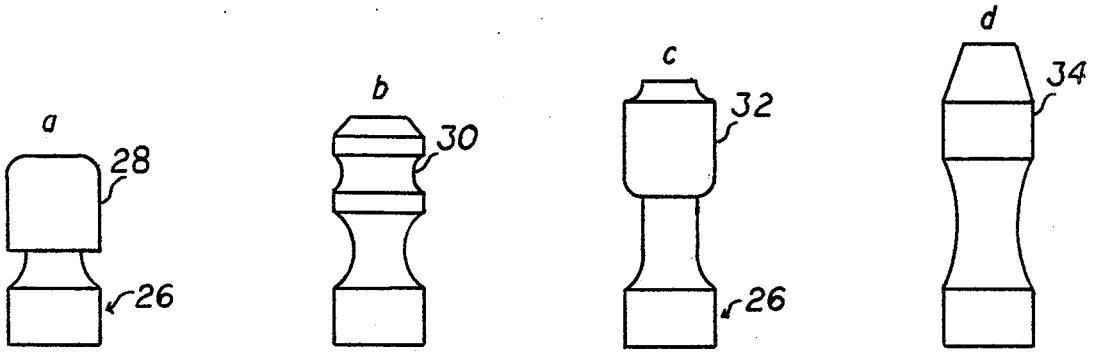
FIGS. 2*a* through 2*d* show four kinds of playing pieces, each a different size to indicate a different value.

The preferred embodiment of the present invention can best be understood with reference to FIGS. 1 and 2, which show the game board and the four kinds of pieces for effecting play thereon.

The board 10 comprises a flat surface 12 on which are drawn or scribed perpendicular lines 14, 16 running north-south and east-west, respectively, to form a rectilinear grid. The grid establishes a plurality of rows and columns defined by a plurality of adjacent square spaces such as indicated at 18.

For illustrative convenience, it will be assumed that player A is located at the northern end 20 of the board, and player B at the southern end 22. In the preferred embodiment, the grid is a square having eight spaces per side, and each player's home zone 24*a*, 24*b* is one space deep and spans the northern and southern ends of the grid, respectively. As described below, one player's home zone is the other player's scoring area.

A set of sixteen pieces, sufficient to occupy all the home zone spaces at the start of the game, is divided equally between the two players. Each player starts with two each of the pieces 26 shown in FIG. 2. The pieces have a unique attribute, such as relative size or other indicia, that are associated with integer movement values such as piece one 28 (FIG. 2*a*); piece two 30 (FIG. 2*b*), piece three 32 (FIG. 2*c*) and piece four 34 (FIG. 2*d*).

Each space in a player's home zone 24 has a corresponding number indicated thereon, beginning with one 36 at the side extremes and increasing sequentially 38, 40 to the maximum of four 42 at the center-most spaces. At the beginning of the game, the pieces 26 are placed on the like-numbered spaces 24 in the home zone 24.

The grid has a second, or side zone 44 at each of the eastern and western ends, each side zone being preferably one space in depth, and extending as a column between the home zones. A safety zone 46 of, preferably, four contiguous spaces is located in the center of the grid, and the remaining spaces constitute the playing zone 48, which is thus bounded at its exterior by the home zones 24 and side zone 44, and on its interior by the safety zone 46.

Preferably, the number of spaces in the playing zone 48 is at least equal to half the total number of spaces on the grid. Also, to more easily distinguish the zones and provide aesthetic appeal, the zones are differentiated by the color of the surface or heavy border lines such as 50,52,54.

The objective of the game is to have the most points when the game ends, by moving the playing pieces 26 from, for example, A player's home zone 24*a* to A player's scoring area 24*b*. The end of the game occurs when one player, when his turn, can no longer make a legal move.

THE RULES

Figure 4:
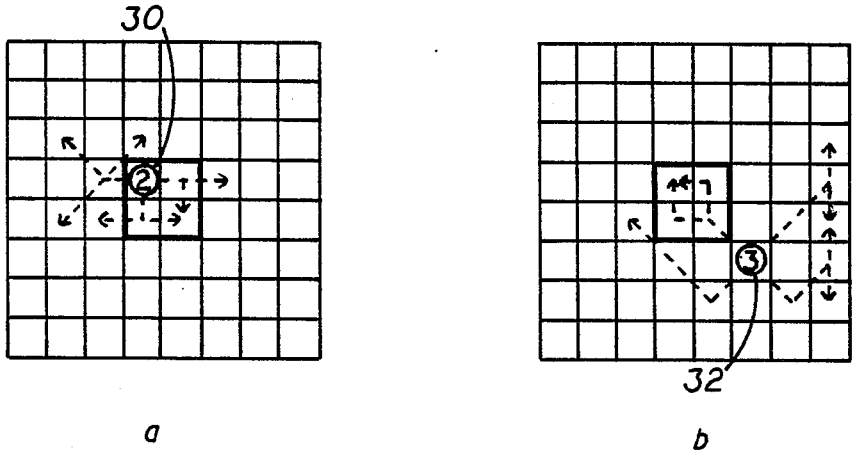
FIGS. 4*a*, 4*b* show typical positional moves that can be made by pieces having values two and three, respectively.
Figure 5:
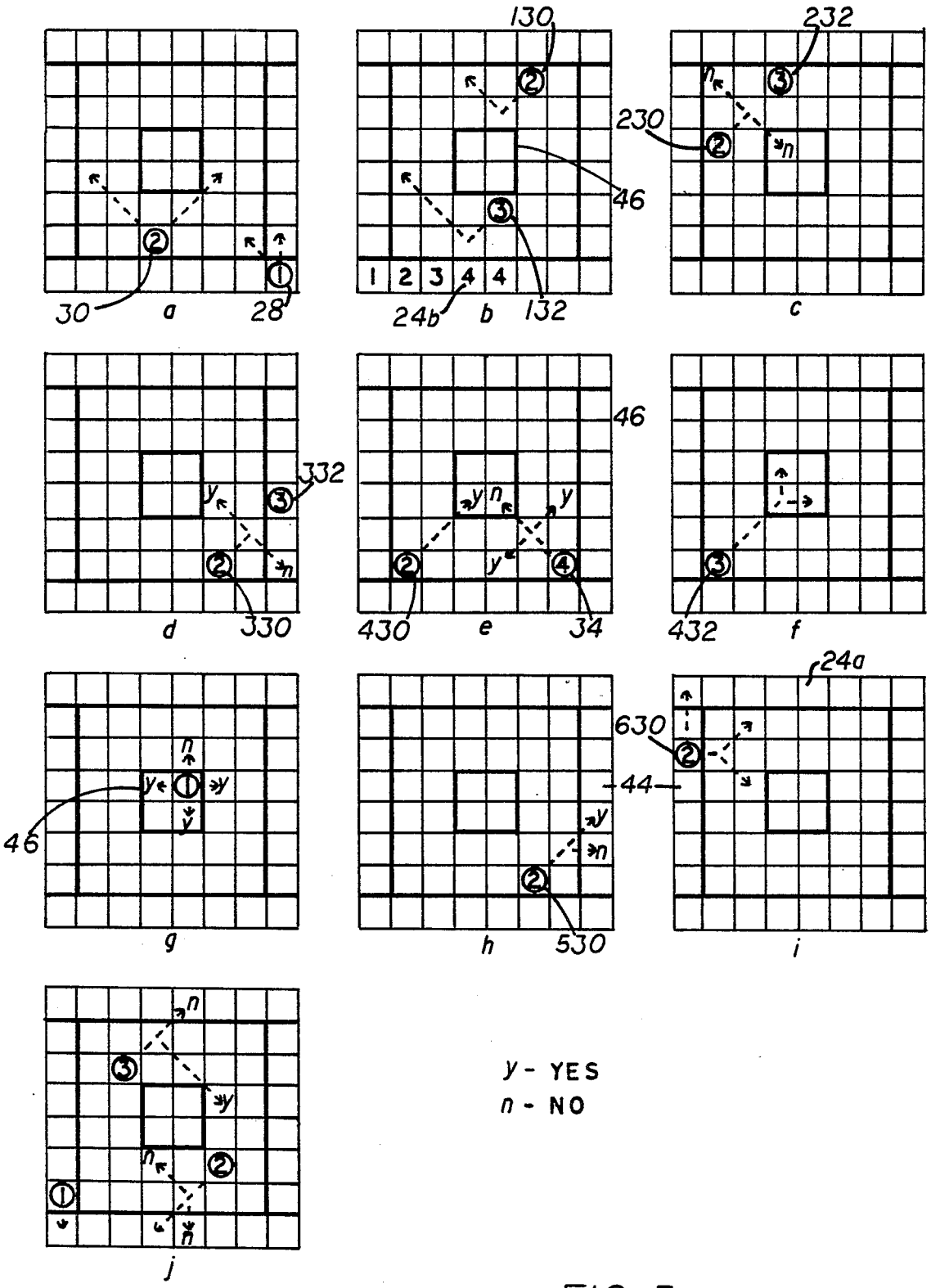
FIGS. 5*a* through 5*j* show positional moves illustrating the application of various preferred rules of play.

The general rules will now be outlined with further reference to FIGS. 4 and 5, which illustrate typical positional moves and specific rules, respectively. The value of a particular piece 26 specifies the number of spaces the piece must move during a given turn. Typical moves of pieces two 30 and three 32 are shown in FIGS. 4*a* and *b*, respectively. Only one piece 26 may be moved per turn.

For ease in understanding the relationship of the FIGS. 5*a* through 5*j*, to the following description of the rules, references to the same piece making a different move will be distinguished by differences in the first digit of the numeric identifier, e.g. piece 32, 132, 232, etc. All moves are diagonal in one continuous direction, as shown in FIG. 5*a*, except that a piece 130 bumping the safety zone 46 or piece 132 bumping the player's own home zone 24*b* must rebound off at an equal angle, as shown in FIG. 5*b*. Piece one 28 may move in any direction in the playing zone.

No piece 230 may jump over or pass through a space occupied by another piece 232 nor rebound off a space occupied by another piece in the same zone, as illustrated in FIG. 5*c*. As shown in FIG. 5*d*, a piece 330 may carom off a space occupied by another piece 332 in a different zone. The moving piece 330 must, however, rebound in a direction away from the zone occupied by the stationary piece 332. No piece may pass through or land on the same space twice in one move, nor leave and re-enter the same zone during a move.

A target piece is captured when an attacking piece lands on the space occupied by the target piece in exact count, except that no piece may be captured in the safety zone 46.

The safety zone 46 must be entered diagonally at the corners only, even by piece one 28, as shown by piece 430 in FIG. 5*e*. Piece four 34 may not enter the safety zone 56, but may carom off the corner. Once within the safety zone, a piece 432 may move during a turn, in a clockwise or counter-clockwise direction as shown in FIG. 5*f*. Exit from the safety zone 46 must be through one of the two sides, facing the size zone, in an east-west direction, as shown in FIG. 5*g*, and continued movement in the playing zone is governed by the general rules set forth above.

Figure 3:
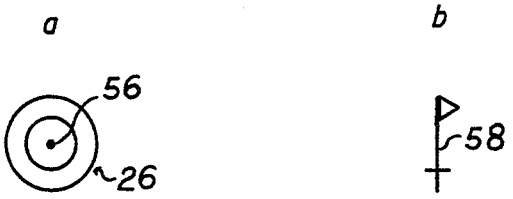
FIGS. 3*a* and 3*b* show, respectively, the top of each piece shown in FIGS. 2*a* through 2*d*, including a centered hole, and a flag for insertion into the hole when the playing piece leaves the safety zone.

No piece may enter the safety zone 46 more than once during a single game. Upon exiting the safety zone, the piece receives and carries a marker for the remainder of the game. FIG. 3*a* shows a top view of each of the pieces 26 shown in FIG. 2, including a central hole 56 into which a marker such as the flag 58 shown in FIG. 3*b*, may be inserted or attached.

With attention again directed to FIGS. 1 and 5, movement within the side zone 44 is in a north-south direction. Entry of a piece 530 into the side zone at any point is by diagonal movement as shown in FIG. 5*h* except that piece one may enter from home zone space one 36. Exit from the side zone is by east-west movement, except that a piece 630 may exit by north-south movement by exact count into the opponent's scoring area 24*a*, as shown in FIG. 5*i*.

FIG. 5*j* shows permitted movements into the scoring area 24*a*,24*b* i.e., the opponent's home zone. Entry must be made by exact count, on a diagonal move, except north-south entry from the side zone is permitted. Caroms, or rebounds are permitted off the scoring area unless the moving piece can enter the scoring zone by exact count.

A player's piece may not be captured while in the scoring area, but it may be captured while in the player's own home zone. A piece entering the scoring area may not be played again during the remainder of the game. A piece may not re-enter a player's home zone.

SCORING

At the conclusion of play, points are awarded and deducted to determine the winner. A piece located in the scoring area, on a space having a value corresponding to the value of the piece, receives the face value of the piece. If located on a scoring zone space of different value, one-half the face value of the piece is awarded.

A player is awarded one-half the face value of each piece captured from his opponent, unless the captured piece carries the marker 58 indicateing it previously sought refuge in the safety zone, in which case full face value is awarded.

A three point bonus is awarded to a player who has moved all his pieces to his scoring area. One-half face value is deducted for each piece not reaching the scoring area, except that full face value is deducted for all pieces remaining in a player's own home zone.

Preferably, a match is won when a player wins two games or scores an accumulated point total of twenty-one, where points are totalled at the end of each game.

SCOPE OF INVENTION

It should be appreciated that the present invention embodies a number of features which may be modified by varying degree without departing from the spirit and scope of the invention as set forth in the following claims.

I claim:

1. A method for playing a game on a board having a flat surface on which is delineated a grid defining a plurality of contiguous spaces grouped by boundaries into a plurality of differentiated zones including home zones at opposite ends of the grid, side zones at opposite sides of the grid extending between the home zones, a playing zone surrounded by the home zones and side zones, and a safety zone surrounded by the playing zone, the game further including a set of movable pieces for each player, each piece having a value attribute, wherein the method of play comprises:

each player initially positioning his pieces in one of the home zones;

each player alternating turns by moving one of his pieces, the movement of the piece being such that the piece moved must be moved the number of spaces indicated by the value attribute associated with that piece, the player's object being to land, by exact count on a space in another player's home zone;

the movement of each piece including the feature that when a piece lands in exact count on a space occupied by another player's piece, said other player's piece is captured and removed from the game, except that when in the safety zone, a piece may not be captured;

the movement of pieces having a value greater than a predetermined minimum value being restricted so that (a) while in the playing zone the piece must move diagonally in one continuous direction, but if the piece thereby bumps the safety zone or the player's own home zone boundary the piece must rebound from the boundary at an equal angle in order to remain in the playing zone, (b) while in a side zone the piece must move toward one of the home zones in order to remain in the side zone; and the players determining the winner at the end of the game by the highest point score wherein points are awarded in relation to the number and value of a player's own pieces that reach another player's home zone and the number and value of another player's captured pieces.

2. The method of claim 1 further including the step of placing a marker on a piece after it has entered the safety zone, to indicate that such piece may not reenter the safety zone during the remainder of the game.

3. The method of claim 2 wherein the step of determining the points awarded for the capture of the other player's pieces includes awarding increased points for captured pieces that carry said marker.

4. The method of claim 1 wherein the step of restricted movement includes restriction on how a piece may cross from one zone to another zone such that (a) entry into the safety zone is only at a corner formed by the intersection of the home zones and said zones;

(b) entry into the side zones from the playing zone is diagonally only;

(c) exit from the side zone into the playing zone is sideways only except that exit can be made by exact count into another player's home zone.

5. The method of claim 4 including the further restriction that entry into another player's home zone from the playing zone must be made diagonally.

6. The method of claim 1 wherein the game ends when one player, when his turn, can no longer make a legal move.

7. The method of claim 1 wherein the step of restricted movement further includes the restriction that a moving piece may not jump over nor rebound from a space occupied by another piece in the same zone, but may rebound from a space occupied by a another piece in a different zone.

8. The method of claim 7 wherein the step of restricted movement further includes the restriction that no piece may leave and reenter the same zone during a given turn.

9. The method of claim 1 including the further restriction that a piece in the safety zone must move in a clockwise or counterclockwise direction to remain in the safety zone.

10. The method of claim 1 wherein the step of determining the winner includes subtracting from the player's score, points dependent on the number and value of the player's pieces that have not reached the other player's home zone.

* * * * *